US010245839B2

(12) United States Patent
Imai et al.

(10) Patent No.: US 10,245,839 B2
(45) Date of Patent: Apr. 2, 2019

(54) CAP FOR INK TANK, INK TANK, AND INK-JET RECORDING APPARATUS

(71) Applicant: Brother Kogyo Kabushiki Kaisha, Nagoya-shi, Aichi-ken (JP)

(72) Inventors: Kenjiro Imai, Toyohashi (JP); Ryuji Kato, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 0 days.

(21) Appl. No.: 15/455,237

(22) Filed: Mar. 10, 2017

(65) Prior Publication Data

US 2017/0282571 A1 Oct. 5, 2017

(30) Foreign Application Priority Data

Mar. 30, 2016 (JP) ..... 2016-069436

(51) Int. Cl.
*B41J 2/175* (2006.01)

(52) U.S. Cl.
CPC ..... *B41J 2/17523* (2013.01); *B41J 2/17503* (2013.01); *B41J 2/17543* (2013.01); *B41J 2/17553* (2013.01)

(58) Field of Classification Search
CPC ..... B41J 2/17506
See application file for complete search history.

(56) References Cited

U.S. PATENT DOCUMENTS 4,977,200 A * 12/1990 Itoh ..... C08J 9/06 523/223
5,609,671 A 3/1997 Nagasawa
5,837,045 A 11/1998 Johnson et al.
6,130,696 A * 10/2000 Mashita ..... B41J 2/17523 347/29
7,819,962 B2 10/2010 Gu
7,922,805 B2 4/2011 Kowalski et al.
8,454,142 B2 6/2013 Bannai et al.
8,858,695 B2 10/2014 Gu et al.
9,090,075 B2 7/2015 Matsumoto et al.
2006/0132555 A1* 6/2006 Uehara ..... B41J 2/17503 347/85
2006/0201380 A1 9/2006 Kowalski et al.
2007/0058017 A1* 3/2007 Morimoto ..... C09D 11/322 347/100
2007/0100023 A1 5/2007 Burns et al.
2007/0100024 A1 5/2007 Gu et al.
2007/0103527 A1* 5/2007 Satoh ..... B41J 2/175 347/100
2009/0229489 A1 9/2009 Gu
2011/0050819 A1 3/2011 Bannai et al.
2012/0125481 A1 5/2012 Matsumoto et al.
(Continued)

FOREIGN PATENT DOCUMENTS

JP H08-003498 A 1/1996
JP 2000-513396 A 10/2000
(Continued)

*Primary Examiner* — Shelby L Fidler
(74) *Attorney, Agent, or Firm* — Banner & Witcoff, Ltd.

(57) ABSTRACT

There is provided an ink tank cap configured to open and close an ink inlet port of an ink tank, the ink tank cap including a contacting portion contacting with the ink inlet port, wherein the contacting portion of the ink tank cap is formed of an ethylene-propylene-diene rubber containing silicone.

15 Claims, 6 Drawing Sheets

(56) References Cited

U.S. PATENT DOCUMENTS

| | | | | |
|---|---|---|---|---|
| 2014/0043408 | A1* | 2/2014 | Kudo | B41J 2/175 347/86 |
| 2015/0049147 | A1* | 2/2015 | Nakano | B41J 2/17506 347/87 |
| 2015/0360476 | A1* | 12/2015 | Osakabe | B41J 2/17553 347/85 |
| 2016/0016408 | A1 | 1/2016 | Matsumoto et al. | |
| 2016/0075880 | A1 | 3/2016 | Gu et al. | |
| 2016/0089893 | A1* | 3/2016 | Osakabe | B41J 2/17513 347/85 |
| 2016/0264306 | A1* | 9/2016 | Nishimaki | B65D 41/005 |
| 2017/0282564 | A1* | 10/2017 | Suzuki | B41J 2/17506 |

FOREIGN PATENT DOCUMENTS

| | | | |
|---|---|---|---|
| JP | 2008-524400 | A | 7/2008 |
| JP | 2009-515007 | A | 4/2009 |
| JP | 2010-241104 | A | 10/2010 |
| JP | 2011-515535 | A | 5/2011 |
| JP | 2012-106363 | A | 6/2012 |

* cited by examiner

Fig. 7A1
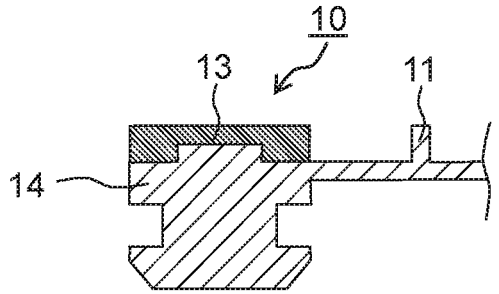
Fig. 7A2
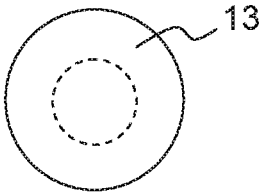
Fig. 7B1
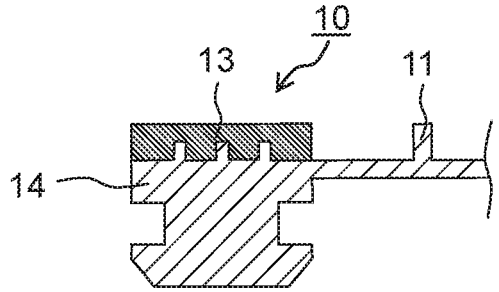
Fig. 7B2
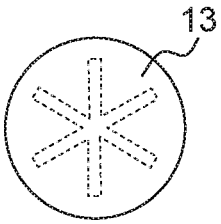
Fig. 7B3
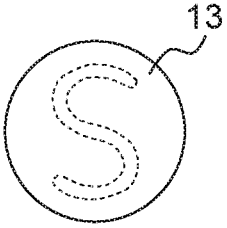

CAP FOR INK TANK, INK TANK, AND INK-JET RECORDING APPARATUS

CROSS REFERENCE TO RELATED APPLICATION

The present application claims priority from Japanese Patent Application No. 2016-069436 filed on Mar. 30, 2016 the disclosure of which is incorporated herein by reference in its entirety.

BACKGROUND

Field of the Invention

The present invention relates to a cap for ink tank (ink tank cap), an ink tank and an ink-jet recording apparatus.

Description of the Related Art

There is proposed an ink-jet recording apparatus configured to supply an ink to an ink-jet head from an ink tank via a tube (see Japanese Patent Application Laid-open No. 2012-106363 corresponding to United States Patent Application Publication No. US 2012/0125481). The ink tank is provided with an ink inlet port. The ink tank is provided with an ink tank plug member (ink tank cap) configured to close (plug, block) the ink inlet port in a case that the ink-jet recording apparatus does not perform a recording operation. A user of the ink-jet recording apparatus can remove the cap from the ink inlet port so as to supplement (refill) the ink to the ink tank.

In a case that the user repeatedly inserts and removes the cap when replenishing the ink, the ink adheres to the ink inlet port, in some cases. In a case that the adhered ink is dried, the viscosity of the dried ink becomes high, which in turn increases the sliding resistance in the cap due to the viscous ink, thereby degrading the insertability/removability (insertion/removal performance) of the cap with respect to the ink inlet port, in some cases.

The present teaching has been made in view of the above-described situations, and an object of the present teaching is to provide an cap for ink tank (hereinafter referred also to as "ink tank cap" as appropriate) in which the insertability/removability thereof is not degraded even if any ink adheres to the ink inlet port of the ink tank.

SUMMARY

According to a first aspect of the present teaching, there is provided an ink tank cap configured to open and close an ink inlet port of an ink tank, the ink tank cap including a contacting portion contacting with the ink inlet port, wherein the contacting portion of the ink tank cap is formed of an ethylene-propylene-diene rubber containing silicone.

According to a second aspect of the present teaching, there is provided an ink tank including:

a tank body having an ink inlet port and configured to accommodate an ink therein; and the ink tank cap of the first aspect.

According to a third aspect of the present teaching, there is provided an ink-jet recording apparatus including:

the ink tank of the second aspect; and an ink-jet head configured to jet the ink accommodated in the tank body.

BRIEF DESCRIPTION OF THE DRAWINGS

FIGS. 7A1 and 7B1 are each a schematic cross-sectional view of a modification of the ink tank cap related to the present teaching as depicted in FIG. 6A, FIG. 7A2 is an example of a plane view depicting the ink tank cap depicted in FIG. 7A1, and FIGS. 7B2 and 7B3 are each a plane view depicting an example of the ink tank cap depicted in FIG. 7B1.

DESCRIPTION OF THE EMBODIMENTS

Figure 1:
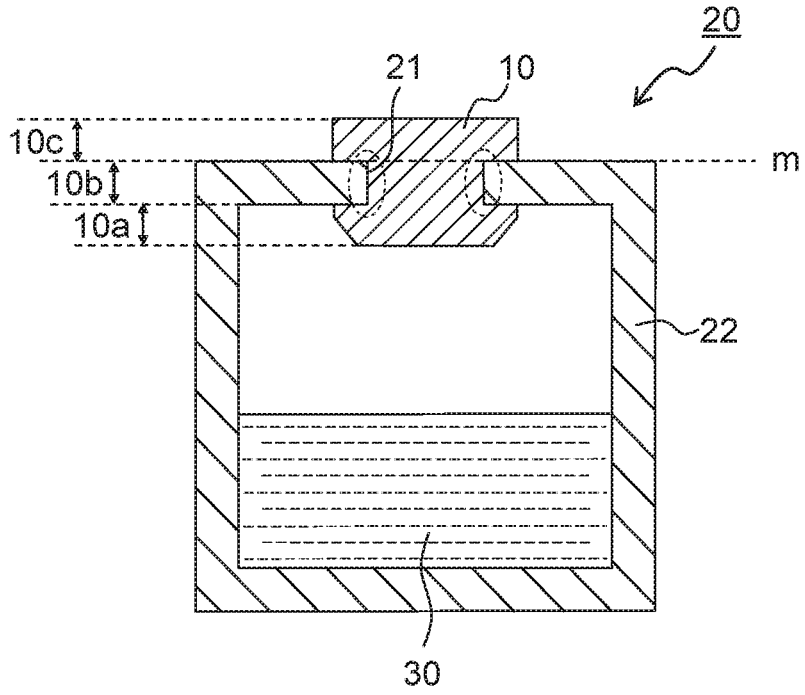
FIG. 1 is a schematic cross-sectional view depicting the configuration of an example of an ink tank related to the present teaching.

In the following, a detailed explanation will be given about a cap for ink tank (ink tank cap), an ink tank and an ink-jet recording apparatus related to the present teaching, with reference to the drawings. Note that, however, the present teaching is not limited to the following explanation. Note that in the following FIGS. 1 to 10, regarding same or similar parts, portions, elements, sections, etc., a same reference sign or numeral is assigned thereto and any explanation therefor will be omitted, in some cases. Further, in the drawings, the constructions or configurations of the respective parts, etc., are appropriately simplified for convenience of explanation in some cases, and the scale ratio, etc., among the respective parts, etc., is indicated as a schematic scale ratio which is different from the actual scale rate, in some cases.

At first, the ink tank cap related to the present teaching will be explained with reference to FIGS. 1 to 8. FIG. 1 is a schematic cross-sectional view depicting the configuration of an example of an ink tank related to the present teaching. As depicted in FIG. 1, an ink tank cap 10 related to the present teaching is configured to close and open an ink inlet port 21 formed in a tank body 22 of an ink tank 20. The ink tank 20 will be described in detail later on. Note that the cross section depicted in FIG. 1 is perpendicular to a plane (reference numeral "m" in FIG. 1) in the outer surface of the ink tank 20 (tank body 22) and including the ink inlet port 21, and passes through the center of the ink inlet port 21.

This is similarly applied to the cross sections of ink tank caps 10 depicted in FIGS. 2 to 8, as well.

The ink tank cap 10 is characterized in that at least a portion (contacting portion), of the ink tank cap 10, which contacts with the ink inlet port 21 is formed of an ethylene-propylene-diene rubber containing silicone (hereinafter referred also as "silicone-containing EPDM" in some cases). In a case that the ink tank cap 10 is attached to the ink tank 20, the ink tank cap 10 is divided (grouped) into a lower portion 10*a* located inside an ink storing chamber in which an ink 30 is stored, a middle portion 10*b* located inside the ink inlet port 21, and an upper portion 10*c* located at the outside of the ink tank 20. Similarly, the outer surface of the ink tank cap 10 is grouped (divided) into a lower region (the outer surface of the lower portion 10*a*) located inside the ink storing chamber in which the ink 30 is stored, a middle region (the outer surface of the middle portion 10*b*) located inside the ink inlet port 21, and an upper region (the outer surface of the upper portion 10*c*) located at the outside of the ink tank 20. In the present teaching, the contacting portion which contacts the ink inlet port 21 is, for example, the middle region and specifically, a portion of the ink tank cap 10 contacting with an inner wall of the ink inlet port 21 (a side surface surrounded by broken lines in FIG. 1). In the ink tank cap 10, since the contacting portion which contacts the ink inlet port 21 is formed of the silicone-containing EPDM, it is possible to suppress any degradation of the insertability/removability even if the ink adheres to the ink inlet port 21. Further, the ink tank cap 10 also achieves an additional effect of providing excellent ink removability after the adhered ink is dried. The reason that the silicone-containing EPDM achieves the above-described effects is presumed as follows. Namely, although the ethylene-propylene-diene rubber (EPDM) is a suitable material for the ink tank cap since the EPDM has a gas permeability, the slidability (sliding performance) of the EPDM is not satisfactory. On the other hand, although the silicone is excellent in the slidability, the gas permeability of the silicone is not satisfactory. Thus, it is presumed that, by mixing the silicone with the EPDM, it is possible to obtain a silicone-containing EPDM which has both excellent in the gas permeability and the slidability.

Note in the ink tank cap 10, it is allowable further that each of a portion in the lower region which contacts an upper wall located inside of the ink storing chamber and a portion in the upper region which contacts an upper wall (of the tank body 22) located outside of the ink storing chamber are formed of the silicone-containing EPDM. In the ink tank cap 10 related to the present teaching, it is allowable that, for example, a portion, of the ink tank cap 10, contacting with a desired portion or location in the ink tank 20 (tank body 22) is coated with the silicone-containing EPDM. Further, in the present teaching, it is allowable, for example, that the entirety of the ink tank cap 10 is formed of the silicone-containing EPDM.

The silicone is a general term of a synthetic high polymer compound having the siloxane linkage as the main skeleton thereof. Although any such a synthetic high polymer compound may be used as the silicone, the silicone is exemplified, for example, by a silicone rubber, silicone oil, etc. The content amount of the silicone in the silicone-containing EPDM is, for example, in a range of 0.1 parts by weight to 25 parts by weight, 0.1 parts by weight to 15 parts by weight, or 1 part by weight to 15 parts by weight with respect to 100 parts by weight of the ethylene-propylene-diene rubber (hereinafter referred also to as "EPDM", in some cases). In a case that the content amount of the silicone is within the above range, the insertability/removability and the ink removability of the ink tank cap 10 as described above are further improved.

Figure 2A:
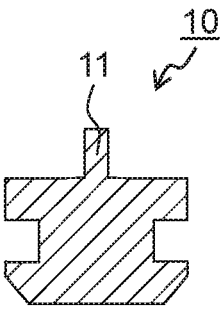
FIGS. 2A to 2C are each a schematic cross-sectional view of an ink tank cap, having a holding portion, related to the present teaching.
Figure 2B:
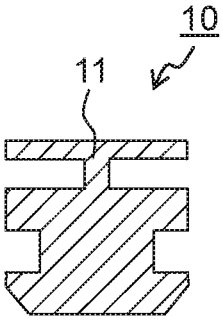
Figure 2C:
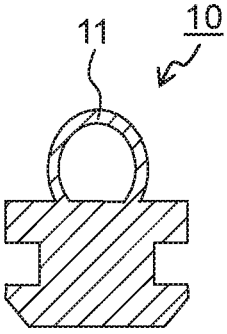
Figure 3A:
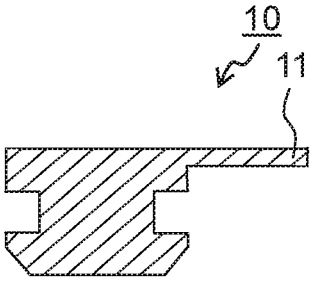
FIGS. 3A to 3C are each a schematic cross-sectional view of an ink tank cap, having a holding portion, related to the present teaching.
Figure 3B:
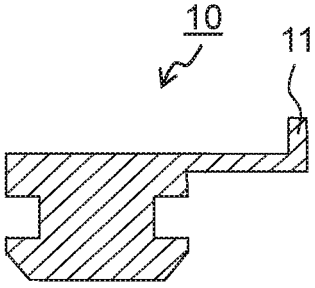
Figure 3C:
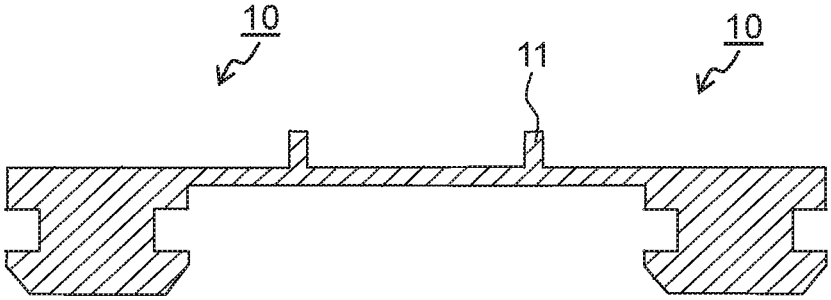

In FIG. 1, a cross-sectional area of each of the lower portion 10*a* and the upper portion 10*c*, which is parallel to the plane (reference numeral "m" in FIG. 1) in the outer surface of the ink tank 20 and including the ink inlet port 21, is greater than that of the middle portion 10*b*, and greater than an area of the ink inlet port 21 in the plane m. The shape of the ink tank cap 10 is not particularly limited, provided that the ink tank cap 10 is capable of opening/closing the ink inlet port 21 by the removal and insertion of the ink tank cap 10 with respect to the ink inlet port 21, and is not limited to the shape depicted in FIG. 1. For example, as depicted in FIGS. 2A to 2C and FIGS. 3A to 3C each of which is a schematic cross-sectional view of the ink tank cap 10, the ink tank cap 10 may have a holding portion (knob, gripper, handle) 11 facilitating the insertion/removal of the ink tank cap 10 to and from the ink inlet port 21. The holding portion 11 is arranged in the upper portion 10*c* (see FIG. 1) of the ink tank cap 10. FIG. 2A depicts an ink tank cap 10 having a stick-shaped or plate-shaped holding portion 11 disposed on an upper portion of the ink tank cap 10. FIG. 2B depicts an ink tank cap 10 having a T-shaped holding portion 11 disposed on an upper portion of the ink tank cap 10. FIG. 2C depicts an ink tank cap 10 having a ring-shaped holding portion 11 disposed on an upper portion of the ink tank cap 10. FIG. 3A depicts an ink tank cap 10 having a stick-shaped or plate-shaped holding portion 11 protruding in the lateral direction. FIG. 3B depicts an ink tank cap 10 having an L-shaped and stick-shaped or L-shaped and plate-shaped holding portion 11 protruding in the lateral direction. According to the ink tank cap 10 having the shape depicted in FIG. 3B, the ink tank cap 10 can be removed (withdrawn) from the ink inlet port 21 more easily, by holding (grasping) the holding portion 11 with fingers and moving the holding portion 11 in a direction separating away from the ink inlet port 21. Further, according to the ink tank cap 10 having the shape depicted in FIG. 3B, the ink inlet port 21 can also be closed (blocked) easily by using the holding portion 11 and inserting the ink tank cap 10 in a pressurized manner with respect to the ink inlet port 21. FIG. 3C depicts a configuration obtained by combining two pieces of the ink tank cap 10 having the shape depicted in FIG. 3B so as to open and close respective ink inlet ports of two adjacent ink tanks. According to the shape depicted in FIG. 3C, for example in an ink tank having a plurality of ink inlet ports respectively for a plurality of colors, or in an set of a plurality of ink tanks having the plurality of ink inlet ports respectively for the plurality of colors, it is possible to reduce the number of parts, etc., including the cap, and thus advantageous in view of the cost, assembling man-power, parts inventory control, etc.

Figure 4:
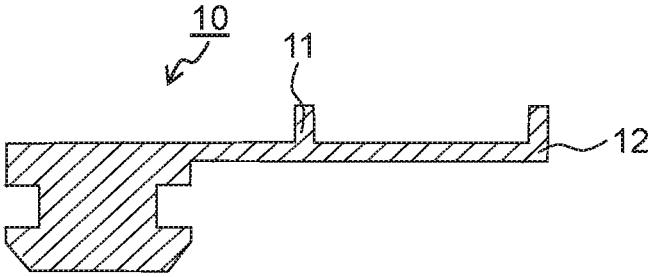
FIG. 4 is a schematic cross-sectional view of an ink tank cap, having a holding portion and a connecting portion, related to the present teaching.

As depicted in a schematic cross-sectional view of FIG. 4, the ink tank cap 10 may have a connecting portion 12 configured to be connected to the tank body 22 (see FIG. 1) of the ink tank 20 or an ink-jet recording apparatus. The connecting portion 12 is arranged in the upper portion 10*c* (see FIG. 1) of the ink tank cap 10. Regarding the ink tank cap 10 as depicted in FIG. 4, since the ink tank cap 10 is connected to the tank body 22 or the ink-jet recording apparatus via the connecting portion 12, there is no need to secure any location at which the ink tank cap 10 is to be placed in a case that the ink tank cap 10 is removed from the ink inlet port 21, and there is no fear that the ink tank cap 10 might be misplaced and/or lost. Further, it is also possible to prevent, for example, occurrence of such a situation that a cap for a tank for accommodating a yellow ink and a cap for a tank for accommodating a black ink are mixed up by mistake, and the cap for the tank for accommodating the black ink is erroneously attached to the tank for accommodating the yellow ink, resulting in the contamination of the yellow ink by the black ink, and the like.

It is allowable that the entirety of the ink tank cap 10 is formed of the silicone-containing EPDM, or may include a portion formed of a material different from the silicone-containing EPDM. There is no particular limitation to the material different from the silicone-containing EPDM, and the material different from the silicone-containing EPDM is exemplified, for example, by a resin, rubber, elastomer, etc. It is preferred, however, that the material different from the silicone-containing EPDM is an elastic material such as a rubber, elastomer, etc., in view of preventing any breakage (exfoliation) in an interface between a portion of the ink tank cap 10 formed of the silicone-containing EPDM and another portion of the ink tank cap 10 formed of the material different from the silicone-containing EPDM, and in view of the insertability/removability with respect to the ink inlet port 21, etc.

The ink tank cap 10 may have a mark (color discriminating member) corresponding to the color of the ink 30 (see FIG. 1) stored or accommodated in the ink tank 20. In a case that the ink tank cap 10 has the mark, it is possible, for example, to prevent the black ink from erroneously being poured into a tank accommodating a color ink, and to prevent the occurrence of such a situation that the cap for the tank for accommodating the yellow ink and the cap for the tank for accommodating the black ink are mixed up by mistake, and the cap for the tank for accommodating the black ink is erroneously attached to the tank for accommodating the yellow ink, resulting in the contamination of the yellow ink by the black ink, and the like. The mark is arranged in the upper portion 10*c* (see FIG. 1) of the ink tank cap 10.

Figure 5:
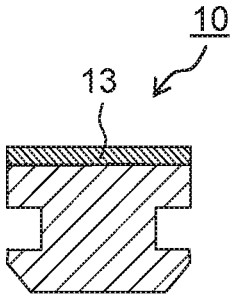
FIG. 5 is a schematic cross-sectional view of an ink tank cap, having a mark, related to the present teaching.

FIG. 5 is a schematic cross-sectional view of an example of such a case that the ink tank cap 10 depicted in FIG. 1 has a mark 13. The mark 13 can be formed, for example, by mixing a colorant, of which color is same as the ink 30, with a resin, rubber, elastomer, etc. which is achromatic or of which color is white or light color, etc. The mark 13 formed in such a manner is used by being adhered or attached to the upper surface of the ink tank 10, as depicted in FIG. 5. Note that the mark 13 can be formed also by coloring a part (portion) or the entirety of the portion formed of the silicone-containing EPDM. Note that the term "mark" described herein means, for example, the entirety of a portion, namely the mark 13 (color discriminating member) formed in the ink tank cap 10 by mixing the colorant of which color is same as the ink 30 (see FIG. 1) with the material forming the ink tank cap 10, as depicted in FIG. 5. This is similarly applicable to those depicted in FIGS. 6 to 8 (to be explained in the following), as well.

Figure 6A:
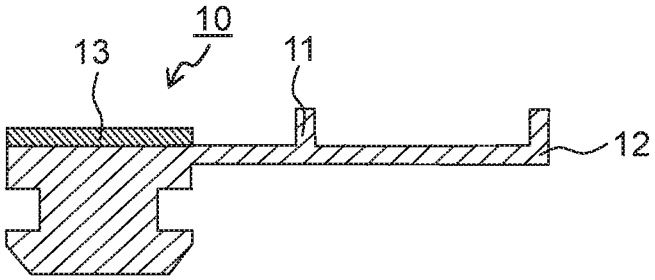
FIGS. 6A and 6B are each a schematic cross-sectional view of an ink tank cap, having a holding portion, a connecting portion and a mark, related to the present teaching.
Figure 6B:
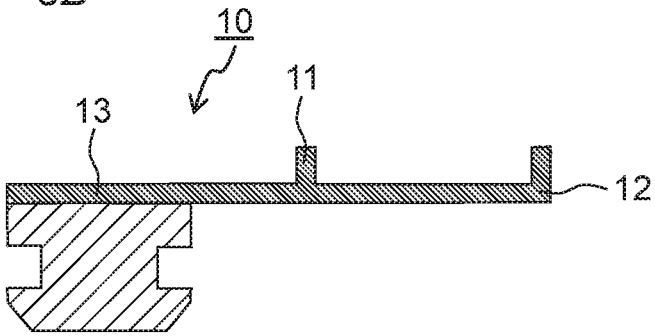

FIGS. 6A and 6B are each a schematic cross-sectional view of an example of such a case that the ink tank cap 10 depicted in FIG. 4 has a mark (color discriminating member) 13. In the examples depicted in FIGS. 6A and 6B, the mark 13 is formed, for example, by mixing a colorant of which color is same as the ink 30 with the material which is different from the silicone-containing EPDM including for example a resin, rubber, elastomer, etc., and which is achromatic or of which color is white or light color. In this case, as depicted in FIG. 6B, it is also possible to form the mark 13, the holding portion 11 and the connecting portion 12 with the material which is different from the silicone-containing EPDM. Alternatively, as depicted in FIG. 6A. it is also possible to form the holding portion 11 and the connecting portion 12 with the silicone-containing EPDM and to form only the mark 13 with the material different from the silicone-containing EPDM. When comparing the aspect depicted in FIG. 6A and the aspect depicted in FIG. 6B, the aspect depicted in FIG. 6A lowers the load generated when the holding portion 11 is moved in the direction separating away from the ink inlet port 21 and applied to the interface between the mark 13 and the portion formed of the silicone-containing EPDM, which is preferred in view of preventing, more effectively, any breakage (exfoliation, detachment) in the interface.

Figure 8A:
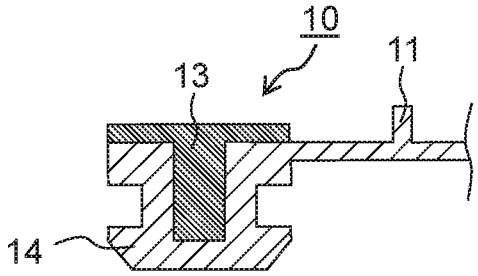
FIGS. 8A to 8C are each a schematic cross-sectional view of a modification of the ink tank cap related to the present teaching as depicted in FIG. 6A.
Figure 8B:
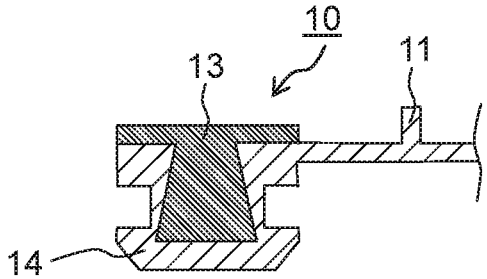
Figure 8C:
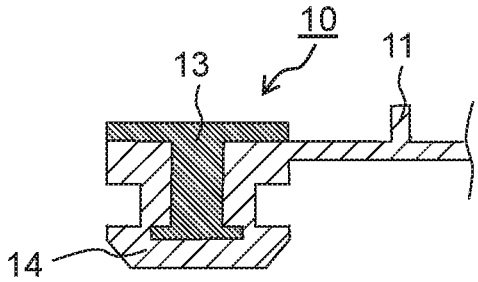

FIGS. 7A1 and 7B1, and FIGS. 8A, 8B and 8C are each a schematic cross-sectional view of a modification of the ink tank cap 10 as depicted in FIG. 6A. Each of the modifications is further devised so as to more suitably prevent any breakage (exfoliation) in the interface between the mark (color discriminating member) 13 and a portion 14, of the ink tank cap 10, which is formed of the silicone-containing EPDM. Specifically, a concavity and a convexity are formed in the boundary between the former and the latter, and the concavity and the convexity are fitted (matched) with each other in the boundary. FIG. 7A1 depicts a configuration wherein a mark (color discriminating member) 13, having a columnar-shaped recessed portion in a plane view as depicted in FIG. 7A2 formed in a lower portion thereof, is adhered to a portion 14, of the ink tank cap 10, formed of the silicone-containing EPDM and having a columnar-shaped projection in the plane view as depicted in FIG. 7A2. FIG. 7B1 depicts a configuration wherein a mark (color discriminating member) 13, having a recessed portion of which shape is * (asterisk, star mark)-shaped in a plane view as depicted in FIG. 7B2, or S-shaped in a plane view as depicted in FIG. 7B3, etc., formed in a lower portion thereof is adhered to a portion 14, of the ink tank cap 10, which is formed of the silicone-containing EPDM and which has a projection having a shape in the plane view corresponding to that of the recessed portion formed in the mark 13 as depicted in FIG. 7B2 or 7B3. FIG. 8A depicts a configuration wherein a mark (color discriminating member) 13, of which cross section is T-shaped and which has a columnar-shaped projection portion formed in a lower portion thereof, is adhered to a portion 14, of the ink tank cap 10, formed of the silicone-containing EPDM and having a columnar-shaped recessed portion formed in an upper portion thereof. FIG. 8B depicts a configuration wherein the projection formed in the lower portion of the mark (color discriminating member) 13 in FIG. 8A is invertedly tapered. FIG. 8C depicts a configuration wherein the projection formed in the lower portion of the mark (color discriminating member) 13 in FIG. 8A is provided with a barb portion.

As explained above, in the ink tank cap related to the present teaching, the contacting portion, which contacts the ink inlet port of the ink tank, is formed of the ethylene-propylene-diene rubber containing silicone. Accordingly, even if the ink adheres to the ink inlet port, the ink tank cap related to the present teaching is capable of suppressing the degradation in the insertability/removability. Further, the ink tank cap related to the present teaching also achieves an additional effect of providing excellent ink removability after the adhered ink is dried.

Next, an ink tank related to the present teaching will be explained. As depicted in FIG. 1, an ink tank 20 related to the present teaching includes a tank main body (tank body) 22 which has an ink inlet port 21 and which accommodates an ink therein; and a cap 10 for ink tank (ink tank cap 10)

configured to open and close the ink inlet port 21. Further, the ink tank 20 related to the present teaching may further include, as a constituent element thereof, an ink 30 (see FIG. 1) stored in the inside of the ink tank 20. The shape, size, etc., of the bank body 22 is not particularly limited, provided that the tank body 22 has the ink inlet port 21 and that the tank body 22 is capable of accommodating the ink 30 in the inside of the tank body 22.

The material for forming the tank body 22 is also not particularly limited. The material for the tank body 22 is exemplified, for example, by polypropylene (PP), polyethylene (PE), a mixed resin of polybutylene terephthalate and acrylonitrile-butadiene-styrene resin (PBT/ABS), polyphenylene ether (PPE), polyacetal (POM), polycarbonate (PC), acrylonitrile-butadiene-styrene resin (ABS), acrylonitrile ethylene-propylene-diene styrene resin (AES), polystylene (PS), etc., among which PP, PE, PBT/ABS, PPE, POM and PC are preferred, and PP, PE, PBT/ABS and PPE are more preferred. In a case that these preferred materials are used as the material for forming the tank body 22, the insertability/removability of the ink tank cap 10 as described above is further improved.

The ink 30 which is accommodated in the tank body 22 is not particularly limited, and may be any ink. The ink 30, however, is exemplified, for example, by a water-based ink containing a colorant, water and a water-soluble organic solvent; and the like. Note that it is allowable that the ink 30 does not contain the colorant. As an ink 30 not containing the colorant is exemplified, for example, by a treatment liquid (treatment solution) containing a coagulant for coagulating the colorant contained in the water-based ink on a recording medium; and the like.

Although the colorant may be either one of a pigment and a dye, the colorant is preferably a pigment. Further, as the colorant, a pigment and a dye may be used in a mixed manner.

The pigment is not particularly limited, and is exemplified, for example, by carbon black, an inorganic pigment, an organic pigment, etc. The carbon black is exemplified, for example, by furnace black, lamp black, acetylene black, channel black, etc. The inorganic pigment is exemplified, for example, by titanium oxide, inorganic pigments based on iron oxide, inorganic pigments based on carbon black, etc. The organic pigment is exemplified, for example, by azo-pigments such as azo lake, insoluble azo-pigment, condensed azo-pigment, chelate azo-pigment, etc.; polycyclic pigments such as phthalocyanine pigment, perylene and perynon pigments, anthraquinone pigment, quinacridone pigment, dioxadine pigment, thioindigo pigment, isoindolinone pigment, quinophthalone pigment etc.; dye lake pigments such as basic dye type lake pigment, acid dye type lake pigment etc.; nitro pigments; nitroso pigments; aniline black daylight fluorescent pigment; and the like. Further, any pigments different from those listed above can be used, provided that such pigments are dispersible in aqueous phase. Specific examples of the pigment include, for example, C. I. Pigment Blacks 1, 6, and 7; C. I. Pigment Yellows 1, 2, 3, 12, 13, 14, 15, 16, 17, 55, 73, 74, 75, 78, 83, 93, 94, 95, 97, 98, 114, 128, 129, 138, 150, 151, 154, 180, 185, and 194; C. I. Pigment Oranges 31 and 43; C. I. Pigment Reds 2, 3, 5, 6, 7, 12, 15, 16, 48, 48:1, 53:1, 57, 57:1, 112, 122, 123, 139, 144, 146, 149, 150, 166, 168, 175, 176, 177, 178, 184, 185, 190, 202, 209, 221, 222, 224, and 238; C. I. Pigment Violets 19 and 196; C. I. Pigment Blues 1, 2, 3, 15, 15:1, 15:2, 15:3, 15:4, 16, 22, and 60; C. I. Pigment Greens 7 and 36; and the like. Further, the pigment may be a solid solution of any one of the above-described pigments.

The pigment may be a self-dispersible pigment. The self-dispersible pigment is dispersible in water without using any dispersant, for example, owing to the fact that at least one of a hydrophilic functional group and the salt thereof including, for example, carbonyl group, hydroxyl group, carboxylic acid group, sulfonic acid group (sulfonate group), phosphoric acid group (phosphate group), etc. is introduced into the surfaces of the particles of the pigment by the chemical bond directly or with any group intervening therebetween. It is possible to use, as the self-dispersible pigments, a self-dispersible pigment wherein the pigment is subjected to a treatment by any one of methods described, for example, in Japanese Patent Application Laid-open No. HEI8-3498 corresponding to U.S. Pat. No. 5,609,671, Published Japanese Translation of PCT International Publication for Patent Application No. 2000-513396 corresponding to U.S. Pat. No. 5,837,045, Published Japanese Translation of PCT International Publication for Patent Application No. 2008-524400 corresponding to United States Patent Application Publication No. US 2006/0201380 A1, Published Japanese Translation of PCT International Publication for Patent Application No. 2009-515007 corresponding to United States Patent Application Publications No. US 2007/0100024 A1, No. US 2007/0100023 A1 and No. US 2016/0075880 A1, Published Japanese Translation of PCT International Publication for Patent Application No. 2011-515535 corresponding to United States Patent Application Publication No. US 2009/0229489 A1, etc. It is possible to use, as a material for the self-dispersible pigment, either one of the inorganic pigment and the organic pigment. Further, a pigment which is suitable for the above-described treatment includes, for example, carbon black such as "MA8", "MA100" and "#2650" produced by MITSUBISHI CHEMICAL CORPORATION; "Color Black FW200", produced by DEGUSSA; etc. As the self-dispersible pigment, it is possible, for example, to use a commercially available product. The commercially available product includes, for example, "CAB-O-JET (trade name) 200", "CAB-O-JET (trade name) 250C", "CAB-O-JET (trade name) 260M", "CAB-O-JET (trade name) 270Y", "CAB-O-JET (trade name) 300", "CAB-O-JET (trade name) 400", "CAB-O-JET (trade name) 450C", "CAB-O-JET (trade name) 465M", "CAB-O-JET (trade name) 470Y" produced by Cabot Corporation; "BONJET (trade name) BLACK CW-2" and "BONJET (trade name) BLACK CW-3" produced by ORIENT CHEMICAL INDUSTRIES, LTD.; "LIOJET (trade name) WD BLACK 002C" produced by TOYO INK SC HOLDINGS CO., LTD.; and the like.

As described above, the ink tank cap 10 related to the present teaching has excellent ink removability after any adhered ink is dried. The effect achieved by the ink tank cap 10 is particularly effective for an ink containing a self-dispersible pigment as the colorant. The reason for this is presumed as follows. Namely, in the portion formed of the silicone-containing EPDM, the re-dispersibility of the self-dispersible pigment in the dried ink is satisfactory.

The solid content blending amount (P) of the pigment (hereinafter also referred to as the "pigment solid content blending amount (P) in some cases) in the entire amount of the water-based ink is not particularly limited, and may be appropriately determined based on, for example, a desired optical density or color (chromaticness, hue, tint), etc. The pigment solid content blending amount (P) is, for example, in a range of 0.1% by weight to 20% by weight, in a range of 1% by weight to 10% by weight, or in a range of 2% by weight to 8% by weight.

Further, in view of suppressing any degradation in the insertability/removability of the ink tank cap 10 with respect to the ink inlet port 21 in such a case that the ink adheres to the ink inlet port 21, the pigment solid content blending amount (P) is preferably not more than 8% by weight. In a case that the ink is dried and the moisture is evaporated, the viscosity of the ink is increased. However, it is presumed that, in a case that the pigment solid content blending amount (P) is not more than 8% by weight, the extent of the increase in the viscosity is small, thereby making it possible to suppress any degradation in the insertability/removability.

The dye is not specifically limited, and is exemplified, for example, by direct dyes, acid dyes, basic dyes, reactive dyes, etc. Specified examples of the dye include, for example, C. I. Direct Black, C. I. Direct Blue, C. I. Direct Red, C. I. Direct Yellow, C. I. Direct Orange, C. I. Direct Violet, C. I. Direct Brown, C. I. Direct Green, C. I. Acid Black, C. I. Acid Blue, C. I. Acid Red, C. I. Acid Yellow, C. I. Acid Orange, C. I. Acid Violet, C. I. Basic Black, C. I. Basic Blue, C. I. Basic Red, C. I. Basic Violet, and C. I. Food Black. C. I. Direct Black is exemplified, for example, by C. I. Direct Blacks 17, 19, 32, 51, 71, 108, 146, 154, and 168. C. I. Direct Blue is exemplified, for example, by C. I. Direct Blues 6, 22, 25, 71, 86, 90, 106, and 199. C. I. Direct Red is exemplified, for example, by C. I. Direct Reds 1, 4, 17, 28, 83, and 227. C. I. Direct Yellow is exemplified, for example, by C. I. Direct Yellows 12, 24, 26, 86, 98, 132, 142, and 173. C. I. Direct Orange is exemplified, for example, by C. I. Direct Oranges 34, 39, 44, 46, and 60. C. I. Direct Violet is exemplified, for example, by C. I. Direct Violets 47 and 48. C. I. Direct Brown is exemplified, for example, by C. I. Direct Brown 109. C. I. Direct Green is exemplified, for example, by C. I. Direct Green 59. C. I. Acid Black is exemplified, for example, by C. I. Acid Blacks 2, 7, 24, 26, 31, 52, 63, 112, and 118. C. I. Acid Blue is exemplified, for example, by C. I. Acid Blues 9, 22, 40, 59, 93, 102, 104, 117, 120, 167, 229, and 234. C. I. Acid Red is exemplified, for example, by C. I. Acid Reds 1, 6, 32, 37, 51, 52, 80, 85, 87, 92, 94, 115, 180, 256, 289, 315, and 317. C. I. Acid Yellow is exemplified, for example, by C. I. Acid Yellows 11, 17, 23, 25, 29, 42, 61, and 71. C. I. Acid Orange is exemplified, for example, by C. I. Acid Oranges 7 and 19. C. I. Acid Violet is exemplified, for example, by C. I. Acid Violet 49. C. I. Basic Black is exemplified, for example, by C. I. Basic Black 2. C. I. Basic Blue is exemplified, for example, by C. I. Basic Blues 1, 3, 5, 7, 9, 24, 25, 26, 28, and 29. C. I. Basic Red is exemplified, for example, by C. I. Basic Reds 1, 2, 9, 12, 13, 14, and 37. C. I. Basic Violet is exemplified, for example, by C. I. Basic Violets 7, 14, and 27. C. I. Food Black is exemplified, for example, by C. I. Food Blacks 1 and 2.

The blending amount of the dye with respect to the entire amount of the water-based ink is not specifically limited, which is, for example, in a range of 0.1% by weight to 20% by weight, or in a range of 0.3% by weight to 10% by weight.

One type of the colorant may be used singly. Alternatively, two or more types of the colorants may be used in combination.

The water is preferably ion-exchanged water or pure water (purified water). The blending amount of the water in the entire amount of the water-based ink may be, for example, the balance of the other components.

The water-soluble organic solvent is exemplified, for example, by a humectant which prevents the water-based ink from drying at an end of a nozzle in an ink-jet head, a penetrant which adjusts the drying velocity on a recording medium, etc. Note that the ink tank cap related to the present teaching is preferably used with respect to an ink tank storing an ink containing the water-soluble organic solvent. The viscosity of the ink containing the water-soluble organic solvent is increased in such a case that the ink is dried and the moisture therein is evaporated, and that the ratio of the water-soluble organic solvent in the ink is increased. To address such a situation, the ink tank cap related to the present teaching is used to thereby make it possible to suppress any degradation in the insertability/removability caused accompanying with the increase in the viscosity of the ink.

The humectant is not particularly limited, and is exemplified, for example, by lower alcohols such as methyl alcohol, ethyl alcohol, n-propyl alcohol, isopropyl alcohol, n-butyl alcohol, sec-butyl alcohol, and tert-butyl alcohol; amides such as dimethylformamide and dimethylacetamide; ketones such as acetone; ketoalcohols (ketone alcohols) such as diacetone alcohol; ethers such as tetrahydrofuran and dioxane; polyethers such as polyalkylene glycol; polyvalent alcohols such as alkylene glycol, glycerol, trimethylolpropane, trimethylolethane, etc.; 2-pyrrolidone; N-methyl-2-pyrrolidone; 1,3-dimethyl-2-imidazolidinone; and the like. The polyalkylene glycol is exemplified, for example, by polyethylene glycol, polypropylene glycol, etc. The alkylene glycol is exemplified, for example, by ethylene glycol, propylene glycol, butylene glycol, diethylene glycol, triethylene glycol, dipropylene glycol, tripropylene glycol, thiodiglycol, hexylene glycol, etc. It is allowable that only one kind of the humectant as described above is used singly, or two or more kinds of the humectant are used in combination. Among the above-described humectants, the humectant is preferably a polyvalent alcohol such as alkylene glycol, glycerol, etc.

The blending amount of the humectant in the entire amount of the water-based ink is, for example, in a range of 0% by weight to 95% by weight, in a range of 5% by weight to 80% by weight, or in a range of 5% by weight to 50% by weight.

The penetrant is not particularly limited, and is exemplified, for example, by glycol ether. The glycol ether is not particularly limited, and is exemplified, for example, by ethylene glycol methyl ether, ethylene glycol ethyl ether, ethylene glycol-n-propyl ether, diethylene glycol methyl ether, diethylene glycol ethyl ether, diethylene glycol-n-propyl ether, diethylene glycol-n-butyl ether, diethylene glycol-n-hexyl ether, triethylene glycol methyl ether, triethylene glycol ethyl ether, triethylene glycol-n-propyl ether, triethylene glycol-n-butyl ether, propylene glycol methyl ether, propylene glycol ethyl ether, propylene glycol-n-propyl ether, propylene glycol-n-butyl ether, dipropylene glycol methyl ether, dipropylene glycol ethyl ether, dipropylene glycol-n-propyl ether, dipropylene glycol-n-butyl ether, tripropylene glycol methyl ether, tripropylene glycol ethyl ether, tripropylene glycol-n-propyl ether, tripropylene glycol-n-butyl ether, etc. One type of the penetrant may be used singly, or two or more kinds of the penetrant may be used in combination.

The blending amount of the penetrant in the entire amount of the water-based ink is, for example, in a range of 0% by weight to 20% by weight, in a range of 0% by weight to 15% by weight, or in a range of 1% by weight to 6% by weight.

In the water-based ink, it is preferred that the solid content blending amount (P) of the pigment and the blending amount (O) of the water-soluble organic solvent in the entire amount of the water-based ink satisfy P/O≤0.5.

As described above, the ink tank cap 10 related to the present teaching suppress any degradation in the insertability/removability of the ink tank cap 10 with respect to the ink inlet port 21 in such a case that the ink adheres to the ink inlet port 21. This effect achieved by the ink tank cap 10 related to the present teaching is particularly effective for an ink in which the ratio (P/O) is within the above range. In a case that the range (P/O) is within the above range, it is presumed the extent of the increase in viscosity of the ink due to the drying is small, thereby making it possible to suppress any degradation in the insertability/removability.

The water-based ink may further contain at least one of a nonionic surfactant and an anionic surfactant. As the nonionic surfactant and the anionic surfactant, it is allowable to use, for example, a commercially available product. The commercially available product of the nonionic surfactant is exemplified, for example, by nonionic surfactants produced by LION SPECIALTY CHEMICALS CO., LTD., including "DOBANOX (trade name)" series, "LEOCOL (trade name)" series, "LEOX (trade name)" series, "LAOL, LEOCON (trade name)" series, "LIONOL (trade name)" series, "CADENAX (trade name)" series, "LIONON (trade name)" series, "LEOFAT (trade name)" series, etc.; nonionic surfactants produced by KAO CORPORATION, including "EMULGEN (trade name)" series, "RHEODOL (trade name)" series, "EMASOL (trade name)" series, "EXCEL (trade name)" series, "EMANON (trade name)" series, "AMIET (trade name)" series, "AMINON (trade name)" series, etc.; nonionic surfactants produced by NISSHIN CHEMICAL CO., LTD., including "OLFIN (trade name)" series; and the like. The commercially available product of the anionic surfactant is exemplified, for example, by anionic surfactants produced by LION SPECIALTY CHEMICALS CO., LTD., including "LIPOLAN (trade name)" series, "LIPON (trade name)" series, "SUNNOL (trade name)" series, "LIPOTAC (trade name)" series, "ENAGICOL (trade name)" series, "LIPAL (trade name)" series, and "LOTAT (trade name)" series, etc.; anionic surfactants produced by KAO CORPORATION including "EMAL (trade name)" series, "LATEMUL (trade name)" series, "VENOL (trade name)" series, "NEOPELEX (trade name)" series, NS SOAP, KS SOAP, OS SOAP, and "PELEX (trade name)" series, etc.; anionic surfactants produced by SANYO CHEMICAL INDUSTRIES, LTD. including "SANDET (trade name)" series and "BEAULIGHT (trade name)" series, etc.; anionic surfactants produced by TOHO CHEMICAL INDUSTRY CO., LTD. including "ALSCOPE (trade name)" series, "NEOSCOPE (trade name)" series, "PHOSFANOL (trade name)" series, etc.; anionic surfactants produced by TOKYO CHEMICAL INDUSTRY CO., LTD. including sodium hexadecyl sulfate, sodium stearyl sulfate, etc.; and the like.

The blending amount of at least one of the nonionic surfactant and the anionic surfactant in the entire amount of the water-based ink is, for example, in a range of 0% by weight to 10% by weight, in a range of 0.01% by weight to 8% by weight, in a range of 0.1% by weight to 5% by weight, or in a range of 0.1% by weight to 1% by weight.

Next, an explanation will be given about an ink-jet recording apparatus related to the present teaching. The ink-jet recording apparatus related to the present teaching includes an ink tank 20 and an ink jetting mechanism. The ink-jet recording apparatus related to the present teaching is characterized by including the ink tank 20, and other configuration different from the inclusion of the ink tank 20 is not particularly limited. The ink-jet recording apparatus related to the present teaching may be similar to a conventionally known ink-jet recording apparatus, except for the inclusion of the ink tank 20. Further, the ink-jet recording apparatus related to the present teaching may further include, as a constituent element thereof, an ink 30 (see FIG. 1) stored in the inside of the ink tank 20.

Figure 9:
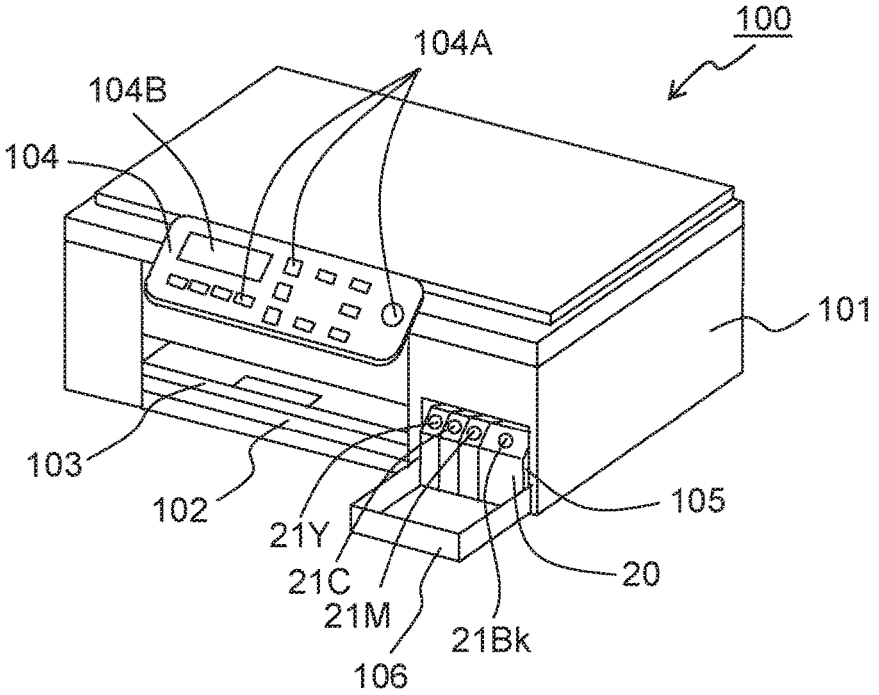
FIG. 9 is a schematic perspective view depicting the configuration of an example of an ink-jet recording apparatus related to the present teaching.

FIG. 9 depicts the configuration of an example of the ink-jet recording apparatus related to the present teaching. As depicted in FIG. 9, an ink-jet recording apparatus 100 has a housing 101 having a substantially rectangular parallelepiped shape. The housing 101 includes a paper feed tray 102, a paper discharge tray 103 and an operation panel 104 which are arranged in the housing 101. The operation panel 104 is provided with an input button 104A and a liquid crystal display 104B. Further, the housing 101 is provided with an opening 105, and the ink tank 20 as depicted in FIG. 1 is accommodated (stored) in the inside of the ink-jet recording apparatus 100 via the opening 105. In a case that ink inlet ports 21Bk, 21M, 21C and 21Y of the ink tank 20 are accommodated in the inside of the ink-jet recording apparatus 100, each of the ink inlet ports 21Bk, 21M, 21C and 21Y is covered by the ink tank cap 10 (see FIG. 10). The housing 101 is provided with a box-shaped cover 106 configured to close (cover) the opening 105.

Figure 10:
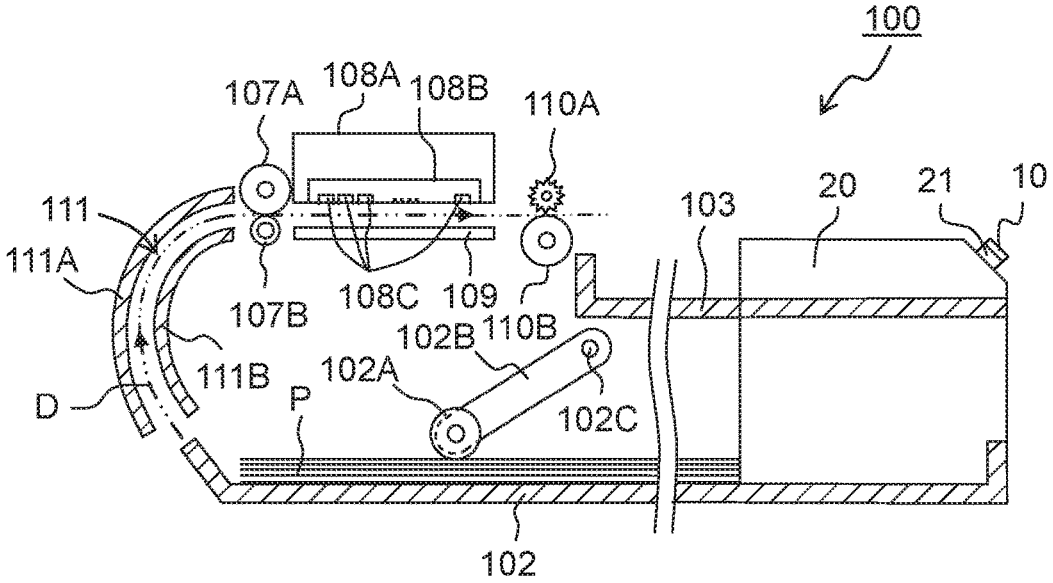
FIG. 10 is a schematic view for explaining the internal configuration of the ink-jet recording apparatus depicted in FIG. 9.

Next, the internal configuration of the ink-jet recording apparatus 100 depicted in FIG. 9 will be explained by using FIG. 10. As depicted in FIG. 10, the ink-jet recording apparatus 100 is provided with the ink tanks 20 in each of which the ink inlet port 21 is closed (blocked) by the ink tank cap 10; the paper feed tray 102; a paper feeding mechanism 102A, 102B, 102C; a conveyance mechanism 107A, 107B; a recording mechanism 108A, 108B; a platen 109; and a paper discharging mechanism 110A, 110B which are arranged in the inside of the ink-jet recording apparatus 100. The paper feed tray 102 is capable of supporting a plurality of pieces of a recording medium (for example, recording paper or recording sheet) P which are stacked.

The paper feeding mechanism is provided with a paper feeding roller 102A, a paper feeding arm 102B and a shaft 102C. The paper feeding roller 102A is rotatably supported by the paper feeding arm 102B at a front end thereof. The paper feeding arm 102B is pivotably supported by the shaft 102C supported by the housing 101. A bias is applied to the paper feeding arm 102B by an elastic force of a spring or by the self-weight of the paper feeding arm 102B such that the paper feeding arm 102B is pivoted and urged toward the paper feed tray 102. The paper feeding roller 102A rotated by being driven by a conveyance motor (not depicted in the drawings) conveys the recording paper P in a conveyance direction D.

As depicted in FIG. 10, in the interior of the ink-jet recording apparatus 100, a conveyance route 111 is defined by an outer guide member 111A and an inner guide member 111B which are arranged to face each other with a predetermined interval (gap) intervened therebetween. The recording paper P conveyed by the paper feeding roller 102A is conveyed to the conveyance mechanism 107A, 107B, via the conveyance route 111.

The conveyance mechanism has a conveyance roller 107A and a pinch roller 107B which are facing each other. The conveyance roller 107A rotates by being driven by a conveyance motor (not depicted in the drawings). The pinch roller 107B rotates following the rotation of the conveyance roller 107A. The recording paper P, conveyed to the conveyance mechanism, is pinched by the conveyance roller 107A and the pinch roller 107B which are rotating, and is conveyed to the recording mechanism 108A, 108B.

The recording mechanism is provided with a carriage 108A and an ink-jet head (ink jetting mechanism) 108B. The carriage 108B is supported by two guide rails (not depicted in the drawings) which are extended respectively in a direction perpendicular to the conveyance direction of the recording paper P. The two guide rails are supported by the housing 101. The carriage 108A is connected to a known belt mechanism (not depicted in the drawings) disposed on the two guide rails. The belt mechanism is driven by a carriage motor (not depicted in the drawings). The carriage 108A connected to the belt mechanism reciprocates in the direction perpendicular to the conveyance direction of the recording paper P, by being driven by the carriage motor.

Further, four ink tubes (not depicted in the drawings) connecting the ink tank 20 with the ink-jet head 108B, and a flexible flat cable (not depicted in the drawings) electrically connecting the ink-jet head 108B to a control circuit board (not depicted in the drawings) are extending from the carriage 108B. A black ink, a magenta ink, a cyan ink and a yellow ink accommodated in the ink tank 20 are supplied, via the four ink tubes, respectively, to the ink-jet head 108B. The flexible flat cable transmits a control signal outputted from the control circuit board to the ink-jet head 108B.

As depicted in FIG. 10, the ink-jet head 108B is mounted on the carriage 108A. A plurality of nozzles 108C are formed in the lower surface of the ink-jet head 108B. End portions (forward end or tip portions) of the nozzles 108C are exposed from the lower surface of the ink-jet head 108B and from the lower surface of the carriage 108A. The ink-jet head 108B has an actuator (not depicted in the drawings) configured to impart a force to jet the ink(s), supplied to the ink-jet head 108B from the ink tank 20 via the ink tube(s). The actuator may be an actuator of any type including the piezoelectric element system, the thermal ink system, the electrostatic suction system, etc. In a process during which the carriage 108A reciprocate in the direction perpendicular to the conveyance direction of the recording paper P, the ink-jet head 108B jets or discharges the ink(s) as fine ink droplets (minute ink droplets) through the nozzles 108C. With this, an image, etc., is recorded on the recording paper P. The platen 109 is arranged so as to face the recording mechanism, and supports the recording paper P conveyed from the conveyance mechanism.

As depicted in FIG. 10, the paper discharging mechanism has a paper discharging roller 110B and a spur 110A which are facing each other. The paper discharging roller 110B rotates by being driven by a conveyance motor (not depicted in the drawings). The spur 110A rotates following the rotation of the paper discharging roller 110B. The recording paper P, after the recording has been performed thereon, is conveyed to the paper discharge tray 103 by being pinched between the paper discharging roller 110B and the spur 110A which are rotating.

EXAMPLES

Next, examples related to the present teaching will be explained together with comparative examples and reference examples. Note that the present teaching is not limited by and is not restricted to the examples, the comparative examples and the reference examples which will be described below.

[Preparation of Ink Tank Cap]

Ink tank caps 1 to 5 and ink tank caps c1 to c3, each having a columnar shape of which diameter was 7.8 mm and of which height was 1.4 mm, were formed by using materials as indicated in TABLE 1 below. Note that in TABLE 1, the unit of the content amount of each of the EPDM and the silicone is "part by weight".

TABLE 1

| | INK TANK CAP | | | | | | | |
|---|---|---|---|---|---|---|---|---|
| | 1 | 2 | 3 | 4 | 5 | c1 | c2 | c3 |
| EPDM | 100 | 100 | 100 | 100 | 100 | Silicone | 100 | Butyl |
| Silicone | 0.1 | 1 | 7 | 15 | 25 | rubber | — | rubber |

[Preparation of Model of Tank Body]

As a model of a tank body having an ink inlet port of which diameter is 7.3 mm, resin test pieces 1 to 9, each having a cylindrical shape of which outer diameter was 8.8 mm and of which inner diameter was 7.3 mm, were formed by using materials as indicated in TABLE 2 below. Note that the length of each of the resin test pieces 1 to 9 was made to be sufficient longer than the height (1.4 mm) of each of the ink tank caps 1 to 5 and c1 to c3.

TABLE 2

| | RESIN TEST PIECE | | | | | | | | |
|---|---|---|---|---|---|---|---|---|---|
| | 1 | 2 | 3 | 4 | 5 | 6 | 7 | 8 | 9 |
| Material | PP | PE | PBT/ ABS | PPE | POM | PC | ABS | AES | PS |

[Preparation of Water-Based Ink]

Components, except for the self-dispersible black pigment, which were included in Ink Composition (TABLE 3, as indicated below) were mixed uniformly or homogeneously; and thus an ink solvent was obtained. Subsequently, the ink solvent was added to the self-dispersible black pigment dispersed in water, followed by being mixed uniformly, and thus a mixture was obtained. After that, the obtained mixture was filtrated through a cellulose acetate membrane filter (pore size 3.00 μm) produced by TOYO ROSHI KAISHA, LTD., and thus water-based inks 1 to 3 indicated in TABLE 3 were obtained.

Aqueous (water) dispersion of C.I. Pigment Red 122 in Ink Composition (TABLE 3) was prepared in the following manner Namely, at first, pure water (purified water) was added to 5.0% by weight of acrylic acid-acrylic acid ester copolymer as a resin dispersant and 20% by weight of C.I. Pigment Red 122 such that the entire amount (content) of the pure water, the copolymer and C.I. Pigment Red 122 became 100% by weight, followed by being subjected to stirring and mixing, and thus a mixture thereof was obtained. Then, the obtained mixture was subjected to a dispersing processing by using a sand mill with zirconia beads for 6 hours. Afterwards, the zirconia beads were separated by a separator, and thus an aqueous dispersion of C.I. Pigment Red 122 was obtained. Next, components, except for the aqueous dispersion of C.I. Pigment Red 122, which were included in Ink Composition (TABLE 3, as indicated below) were mixed uniformly or homogeneously; and thus an ink solvent was obtained. Subsequently, the aqueous dispersion of C.I. Pigment Red 122 was added to the ink solvent, followed by being mixed uniformly, and thus a mixture was obtained. After that, the obtained mixture was filtrated through a cellulose acetate membrane filter (pore size 3.00 μm) produced by TOYO ROSHI KAISHA, LTD., and thus water-based inks 4 and 5 indicated in TABLE 3 were obtained.

Table 3 (Following)—Legend

TABLE 3

| | | | WATER-BASED INK | | | | |
|---|---|---|---|---|---|---|---|
| | | | 1 | 2 | 3 | 4 | 5 |
| Ink Composition (% by weight) | Pigment (P) | CAB-O-Jet (trade name) 300 (*1) | 4 | 6 | 8 | — | — |
| | | Aqueous dispersion of C.I. Pigment Red 122 (*2) | — | — | — | 8 | 9 |
| | Water-soluble organic solvent (O) | Glycerol | 10 | 14 | 14 | 14 | 14 |
| | | Triethylene glycol | 4 | — | — | — | — |
| | | Triethylene glycol-n-butyl ether | 1 | 3 | 3 | 3 | 3 |
| | | Dipropylene glycol-n-propyl ether | 2 | — | — | — | — |
| | Surfactant | OLFIN (trade name) E1010 (*3) | 1 | 1 | 0.5 | 1 | 1 |
| | | SUNNOL (trade name) NL-1430 (*4) | — | — | 0.5 | — | — |
| | | Water | balance | balance | balance | balance | balance |
| | P/O | | 0.24 | 0.35 | 0.47 | 0.47 | 0.53 |

(*1) Self-dispersible black pigment; produced by CABOT CORPORATION.
(*2) Resin dispersion type pigment.
(*3) Nonionic surfactant produced by NISSHIN CHEMICAL CO., LTD.
(*4) Anionic surfactant produced by LION SPECIALTY CHEMICALS CO., LTD.

Numerals in the table indicate the solid content amount for the pigments, and indicate the active ingredient amount for the surfactants.

Examples 1-1 to 1-5 and Comparative Examples 1-1 to 1-3

With respect to the ink tank caps 1 to 5 and the ink tank caps c1 to c3 as indicated in TABLE 1, the resin test piece 1 indicated in TABLE 2 and the water-based ink 2 indicated in TABLE 3 were used to perform: (a) Evaluation of sliding resistance (without ink adhesion), (b) Evaluation of sliding resistance (with ink adhesion), and (c) Evaluation of ink removability were performed by the following methods.

(a) Evaluation of Sliding Resistance (without Ink Adhesion)

The ink tank cap was inserted to a cylindrical portion of the resin test piece 1, and a tensile compression test machine, model name "EZ Test/CE" manufactured by SHIMAZU CORPORATION was used to measure the sliding resistance, applied to the ink tank cap, at the test rate of 100 mm/minute. Then, the evaluation was made according to the following evaluation criteria. Note that in a case that the result of this evaluation of the sliding resistance (without ink adhesion) is satisfactory, it is possible to determine that the ink tank cap is an ink tank cap which has excellent insertability/removability in a state that the ink is not adhered to the ink inlet port in the ink tank.

<Criteria for Evaluation of Sliding Resistance (without Ink Adhesion)>

A: The load applied to the ink tank cap in a case that the ink tank cap was moved and deformed by 0.3 mm was not more than 2.0 N.

B: The load applied to the ink tank cap in a case that the ink tank cap was moved and deformed by 0.3 mm exceeded 2.0 N and was not more than 2.5 N.

C: The load applied to the ink tank cap in a case that the ink tank cap was moved and deformed by 0.3 mm exceeded 2.5 N.

(b) Evaluation of Sliding Resistance (with Ink Adhesion)

A portion of the ink tank cap and a portion of the cylindrical portion of the resin test piece 1, at which the ink tank cap and the cylindrical portion made contact with each other when the ink tank cap was inserted into the cylindrical portion, were coated with the water-based ink 2. The tensile compression test machine, model name "EZ Test/CE" manufactured by SHIMAZU CORPORATION was used to measure the sliding resistance, applied to the ink tank cap, at the test rate of 100 mm/minute for two times that were immediately after the water-based ink 2 was coated, and then the water-based ink 2 was dried by being stored for 216 hours in an environment in which the temperature was 60° C. and the relative humidity was 20%. Then, the evaluation was made according to the following evaluation criteria. Note that in a case that the result of this evaluation of the sliding resistance (with ink adhesion) is satisfactory, it is possible to determine that the ink tank cap is an ink tank cap which has excellent insertability/removability in a state that the ink adheres to the ink inlet port in the ink tank.

<Criteria for Evaluation of Sliding Resistance (with Ink Adhesion)>

A: The load applied to the ink tank cap in a case that the ink tank cap was moved and deformed by 0.3 mm, after the drying of the water-based ink 2 was not more than 1.2 times that applied immediately after the coating of the water-based ink 2.

B+: The load applied to the ink tank cap in a case that the ink tank cap was moved and deformed by 0.3 mm, after the drying of the water-based ink 2 exceeded 1.2 times and was not more than 1.6 times that applied immediately after the coating of the water-based ink 2.

B: The load applied to the ink tank cap in a case that the ink tank cap was moved and deformed by 0.3 mm, after the drying of the water-based ink 2 exceeded 1.6 times and was not more than 2.2 times that applied immediately after the coating of the water-based ink 2.

C: The load applied to the ink tank cap in a case that the ink tank cap was moved and deformed by 0.3 mm, after the drying of the water-based ink 2 exceeded 2.2 times that applied immediately after the coating of the water-based ink 2.

(C) Evaluation of Ink Removability

A region of 50 mm×50 mm in the ink tank cap was coated with 0.1 mL of the water-based ink 2, followed by being stored for 24 hours in an environment in which the temperature was 60° C. and the relative humidity was 20%. After the storage, pure water (purified water) was pursed into the portion, of the ink tank cap, coated with the water-based ink 2, and the visual evaluation was performed according to the following evaluation criteria.

<Criteria for Evaluation of Ink Removability>

A: There was not any dried ink residue in the portion coated with the water-based ink 2.

B+: There was not any dried ink residue in not less than 90% of the area of the portion coated with the water-based ink 2.

B: There was not dried ink residue in not less than 50% of the area of the portion coated with the water-based ink 2.

C: There was a dried ink residue in not less than 50% of the area of the portion coated with the water-based ink 2.

The ink tank caps, the resin test piece, and the water-based ink used in Examples 1-1 to 1-5 and Comparative Examples 1-1 to 1-3, and the results of evaluations therefore are indicated in TABLE 4.

Table 4 (Following)—Legend

TABLE 4

| | EXAMPLES | | | | | COMPARATIVE EXAMPLES | | |
|---|---|---|---|---|---|---|---|---|
| | 1-1 | 1-2 | 1-3 | 1-4 | 1-5 | 1-1 | 1-2 | 1-3 |
| Ink tank cap | 1 | 2 | 3 | 4 | 5 | c1 | c2 | c3 |
| Resin test piece (*5) | | | | | 1 | | | |
| Water-based ink (*6) | | | | | 2 | | | |
| Sliding resistance (without ink adhesion) | B | A | A | A | A | A | C | C |
| Sliding resistance (with ink adhesion) | A | A | A | A | B | C | C | C |
| Ink removability | B | A | A | A | A | B | C | C |

(*5) Resin test piece used in the evaluation of sliding resistance (without ink adhesion) and in the evaluation of sliding resistance (with ink adhesion).
(*6) Water-based ink used in the evaluation of sliding resistance (with ink adhesion) and in the evaluation of ink removability.

As indicated in TABLE 4, in Examples 1-1 to 1-5 (ink tank caps 1 to 5), the results in all of the evaluation of sliding resistance (without ink adhesion), the evaluation of sliding resistance (with ink adhesion), and the evaluation of ink removability were satisfactory. In particular, in Examples 1-2 to 1-4 (ink tank caps 2 to 4) in which the content amount of the silicone in the silicone-containing EPDM was in the range of 1 part by weight to 15 parts by weight, with respect to 100 parts by weight of the EPDM, the results in all of the evaluation of sliding resistance (without ink adhesion), the evaluation of sliding resistance (with ink adhesion), and the evaluation of ink removability were quite satisfactory. On the other hand, in Comparative Example 1 (ink tank cap c1) formed of the silicone rubber, the result of the evaluation of sliding resistance (with ink adhesion) was unsatisfactory. Further, in Comparative Examples 1-2 and 1-3 which were formed of the EPDM not containing the silicone and the butyl rubber, respectively, the results in all of the evaluation of sliding resistance (without ink adhesion), the evaluation of sliding resistance (with ink adhesion), and the evaluation of ink removability were unsatisfactory.

Examples 2-1 to 2-13

With respect to the ink tank cap 3 as indicated in TABLE 1, the resin test pieces 1 to 9 indicated in TABLE 2 and the water-based inks 1 to 5 indicated in TABLE 3 were used to perform the evaluation of sliding resistance (with ink adhesion), in a similar manner as in Examples 1-1 to 1-5 and Comparative Examples 1-1 to 1-3.

The ink tank cap, the resin test pieces, the water-based inks used in Examples 2-1 to 2-13, and the results of evaluation therefore are indicated in TABLE 5.

TABLE 5

| | EXAMPLES | | | | | | | | | | | | |
|---|---|---|---|---|---|---|---|---|---|---|---|---|---|
| | 2-1 | 2-2 | 2-3 | 2-4 | 2-5 | 2-6 | 2-7 | 2-8 | 2-9 | 2-10 | 2-11 | 2-12 | 2-13 |
| Ink tank cap | | | | | | | | 3 | | | | | |
| Resin test piece (*5) | | | 1 | | | 2 | 3 | 4 | 5 | 6 | 7 | 8 | 9 |
| Water-based ink (*6) | 1 | 2 | 3 | 4 | 5 | | | | | 2 | | | |
| Sliding resistance (with ink adhesion) | A | A | A | A | B | A | A | A | B+ | B+ | B+ | B+ | B+ |

As indicated in TABLE 5, in Examples 2-1 to 2-13, the results in the evaluation of sliding resistance (with ink adhesion) were satisfactory. In particular, in Examples 2-1 to 2-4 and 2-6 to 2-8 each using one of the water-based inks 1 to 4 in which P/O≤0.5 was satisfied and each using one of the resin test pieces 1 to 4 formed of PP, PE, PBT/ABS and PPE, the results in the evaluation of sliding resistance (with ink adhesion) were quite satisfactory. Further, in Examples 2-1 to 2-4 and 2-6 to 2-8 in each of which the result of the evaluation of sliding resistance (without ink adhesion) was quite satisfactory, the pigment solid content blending amount (P) in the entire amount of the water-based pigment ink was not more than 8% by weight.

Examples 3-1 to 3-5

With respect to the ink tank cap 3 as indicated in TABLE 1, the water-based inks 1 to 5 indicated in TABLE 3 were used to perform the evaluation of ink removability, in a similar manner as in Examples 1-1 to 1-5 and Comparative Examples 1-1 to 1-3.

The ink tank cap and the water-based inks used in Examples 3-1 to 3-5, and the results of evaluation therefore are indicated in TABLE 6.

TABLE 6

| | EXAMPLES | | | | |
|---|---|---|---|---|---|
| | 3-1 | 3-2 | 3-3 | 3-4 | 3-5 |
| Ink tank cap | | | 3 | | |
| Water-based ink | 1 | 2 | 3 | 4 | 5 |
| Ink Removability | A | A | A | B+ | B |

As indicated in TABLE 6, in Examples 3-1 to 3-5, the results in the evaluation of ink removability was satisfactory. In particular, in Examples 3-1 to 3-3 each using one of the water-based inks 1 to 3 containing the self-dispersible pigment, the results of the evaluation of the ink removability were quite satisfactory.

As described above, the ink tank cap related to the present teaching is capable of suppressing any degradation in the insertability/removability even if any ink adheres to the ink inlet port of the ink tank. The usage of the ink tank cap related to the present teaching is not particularly limited, and is widely applicable to a variety of kinds of the ink tank.

What is claimed is:

1. An ink tank comprising:

a tank body having an ink inlet port and configured to accommodate an ink therein; and an ink tank cap configured to open and close the ink inlet port of the ink tank, and having a contacting portion of which contacts with the ink inlet port, and which is formed of an ethylene-propylene-diene rubber containing silicone;

a content amount of the silicone in the ethylene-propylene-diene rubber containing the silicone is in a range of 1 part by weight to 15 parts by weight with respect to 100 parts by weight of the ethylene-propylene-diene rubber; and a material forming the tank body is selected from the group consisting of polypropylene, polyethylene, polyphenylene ether, and a mixed resin of polybutylene terephthalate and an acrylonitrile-butadiene-styrene resin.

2. The ink tank according to claim 1, further comprising the ink accommodated in the tank body, wherein the ink is a water-based pigment ink containing a pigment, water and a water-soluble organic solvent.

3. The ink tank according to claim 2, wherein a solid content blending amount (P) of the pigment and a blending amount (O) of the water-soluble organic solvent in an entire amount of the water-based pigment ink satisfies $P/O \leq 0.5$.

4. The ink tank according to claim 2, wherein the pigment is a self-dispersible pigment.

5. The ink tank according to claim 2, wherein a solid content blending amount (P) of the pigment in an entire amount of the water-based pigment ink is in a range of 1% by weight to 10% by weight.

6. The ink tank according to claim 2, wherein a solid content blending amount (P) of the pigment in an entire amount of the water-based pigment ink is not more than 8% by weight.

7. The ink tank according to claim 2, wherein a material forming the tank body is one selected from the group consisting of: polypropylene, polyethylene, polyphenylene ether, and a mixed resin of polybutylene terephthalate and an acrylonitrile-butadiene-styrene resin; and wherein a solid content blending amount (P) of the pigment and a blending amount (O) of the water-soluble organic solvent in an entire amount of the water-based pigment ink satisfies $P/O \leq 0.5$.

8. The ink tank according to claim 1, wherein the ink tank cap further has a portion which is formed of a material different from the ethylene-propylene-diene rubber containing the silicone.

9. The ink tank according to claim 1, wherein an entirety of the ink tank cap is formed only of the ethylene-propylene-diene rubber containing the silicone.

10. The ink tank according to claim 1, wherein the ink tank cap further has a mark corresponding to a color of the ink accommodated in the ink tank.

11. The ink tank according to claim 1, wherein the ink tank cap further has a holding portion.

12. The ink tank according to claim 1, wherein the ink tank cap further has a connecting portion configured to be connected to the tank body.

13. The ink tank according to claim 1, wherein in a case that the ink tank cap closes the ink inlet port of the ink tank, the ink tank cap is divided into a lower portion located inside an ink storing chamber, of the ink tank, in which an ink is stored, a middle portion located inside the ink inlet port and an upper portion located at an outside of the ink tank, and wherein a cross-sectional area of each of the lower portion and the upper portion, which is parallel to a plane on an outer surface of the ink tank and including the ink inlet port, is greater than that of the middle portion.

14. An ink-jet recording apparatus comprising:

the ink tank as defined in claim 1; and an ink-jet head configured to jet the ink accommodated in the tank body.

15. The ink-jet recording apparatus according to claim 14, further comprising the ink accommodated in the tank body.

* * * * *